US011700934B2

(12) United States Patent
Laurent

(10) Patent No.: US 11,700,934 B2
(45) Date of Patent: Jul. 18, 2023

(54) TOOTHBRUSH WITH REPLACEMENT TOOTHBRUSH HEADS STORED IN HANDLE

(71) Applicant: Jean Paul Laurent, New York, NY (US)

(72) Inventor: Jean Paul Laurent, New York, NY (US)

( * ) Notice: Subject to any disclaimer, the term of this patent is extended or adjusted under 35 U.S.C. 154(b) by 37 days.

(21) Appl. No.: 17/164,304

(22) Filed: Feb. 1, 2021

(65) Prior Publication Data

US 2022/0240658 A1 Aug. 4, 2022

(51) Int. Cl.
*A46B 7/04* (2006.01)
*A46B 9/04* (2006.01)

(52) U.S. Cl.
CPC . *A46B 7/04* (2013.01); *A46B 9/04* (2013.01)

(58) Field of Classification Search
None
See application file for complete search history.

(56) References Cited

U.S. PATENT DOCUMENTS 2,848,002 A * 8/1958 Hirschfeldt ..... A46B 7/04 15/187
3,593,725 A * 7/1971 Ortega ..... A46B 5/0095 132/311
4,362,174 A * 12/1982 Baker ..... A46B 7/04 15/176.1
4,503,871 A * 3/1985 Mendenhall ..... A46B 11/0003 401/268
5,247,718 A * 9/1993 Victorian ..... A46B 7/04 15/178
6,817,803 B1 * 11/2004 Ong ..... A46B 11/0079 401/184
8,881,333 B1 * 11/2014 Malakova ..... A46B 7/04 15/176.4
2003/0019062 A1 * 1/2003 Florence ..... A46B 15/0061 15/167.1
2009/0091178 A1 * 4/2009 Waguespack ..... A46D 3/04 15/167.1
2019/0248049 A1 * 8/2019 Jungnickel ..... A46B 5/0095

FOREIGN PATENT DOCUMENTS

CN 201388691 Y 1/2010
CN 202739166 U 2/2013
KR 20170082725 A 7/2017
WO WO-2009045083 A2 * 4/2009 ..... A61K 31/138

* cited by examiner

*Primary Examiner* — Monica S Carter
*Assistant Examiner* — Dana Lee Poon
(74) *Attorney, Agent, or Firm* — Foley Hoag LLP; Stephen J. Kenny; Lee Chedister

(57) ABSTRACT

A toothbrush device includes a detachably attached toothbrush head. The device includes a handle having a compartment therein for storing replacement toothbrush heads. The handle has a first section and a second section detachably connected together to form the compartment. The replacement toothbrush heads are detachably secured to the second section of the handle. The user can detach the second section from the first section to access the replacement toothbrush heads such that the user can replace the toothbrush head in the toothbrush head holder with a replacement toothbrush head, when desired.

19 Claims, 5 Drawing Sheets

TOOTHBRUSH WITH REPLACEMENT TOOTHBRUSH HEADS STORED IN HANDLE

BACKGROUND

The present application relates generally to toothbrushes and, more particularly, to a toothbrush with a handle holding multiple replacement toothbrush heads.

BRIEF SUMMARY OF THE DISCLOSURE

In accordance with one or more embodiments, a toothbrush device useable by a user includes a toothbrush head having a base and toothbrush bristles for brushing teeth extending from a front face of the base and a snap-fit feature on an opposite back face of the base. A toothbrush head holder has a snap-fit feature mated with the snap-fit feature of the toothbrush head for detachably holding the toothbrush head in a use position to be used for brushing the user's teeth. A handle has one end connected to the toothbrush head holder. The handle has a compartment therein for storing replacement toothbrush heads, each of the replacement toothbrush heads has a base and toothbrush bristles for brushing teeth extending from a front face of the base and a snap-fit feature on an opposite back face of the base. The handle has a first section and a second section detachably connected together to form the compartment. The second section including one or more snap-fit features mated with the snap-fit features of the replacement toothbrush heads for detachably holding the replacement toothbrush heads in the compartment. The user can detach the second section from the first section to enable access the replacement toothbrush heads stored in the compartment such that the user can replace the toothbrush head in the toothbrush head holder with a replacement toothbrush head by snap-fitting the replacement toothbrush head in the toothbrush head holder, when desired.

In accordance with one or more embodiments, a method of replacing a toothbrush head in a toothbrush device includes the steps of: (a) removing the toothbrush head from a toothbrush head holder of the toothbrush device, the toothbrush head holder detachably holding the toothbrush head; (b) accessing a replacement toothbrush head stored in a compartment in a handle of the toothbrush device connected to the toothbrush head holder by separating two snap-fitted sections forming the handle, wherein the replacement toothbrush head is detachably secured to one of the two sections; (c) removing the replacement toothbrush head from the one of the two sections; (d) reconnecting the two sections together by snap-fitting the sections to form the handle; and (e) securing the replacement toothbrush head in the toothbrush head holder to enable the toothbrush device to be used to brush a user's teeth.

BRIEF DESCRIPTION OF THE DRAWINGS

Like or identical reference numbers are used to identify common or similar elements.

DETAILED DESCRIPTION

Figure 1:
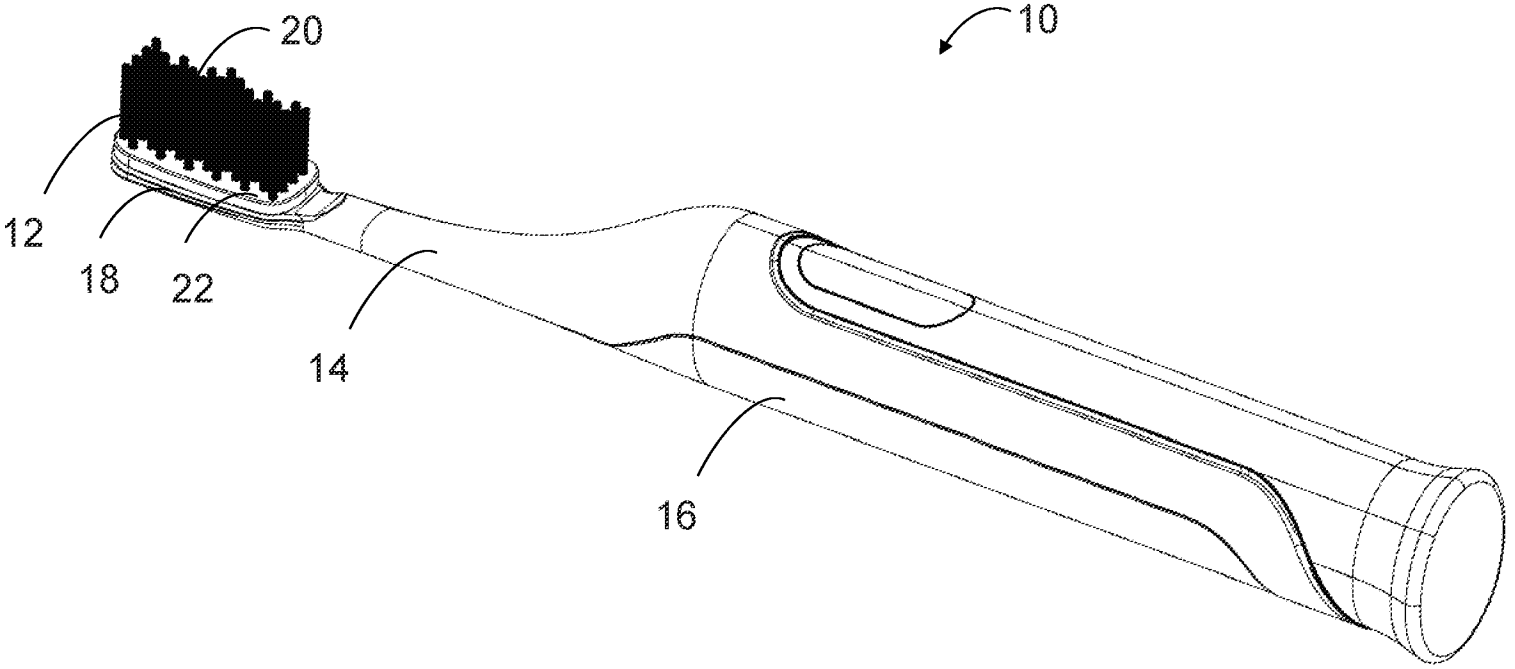
FIG. 1 is a top perspective view of a toothbrush in accordance with one or more embodiments.
Figure 2:
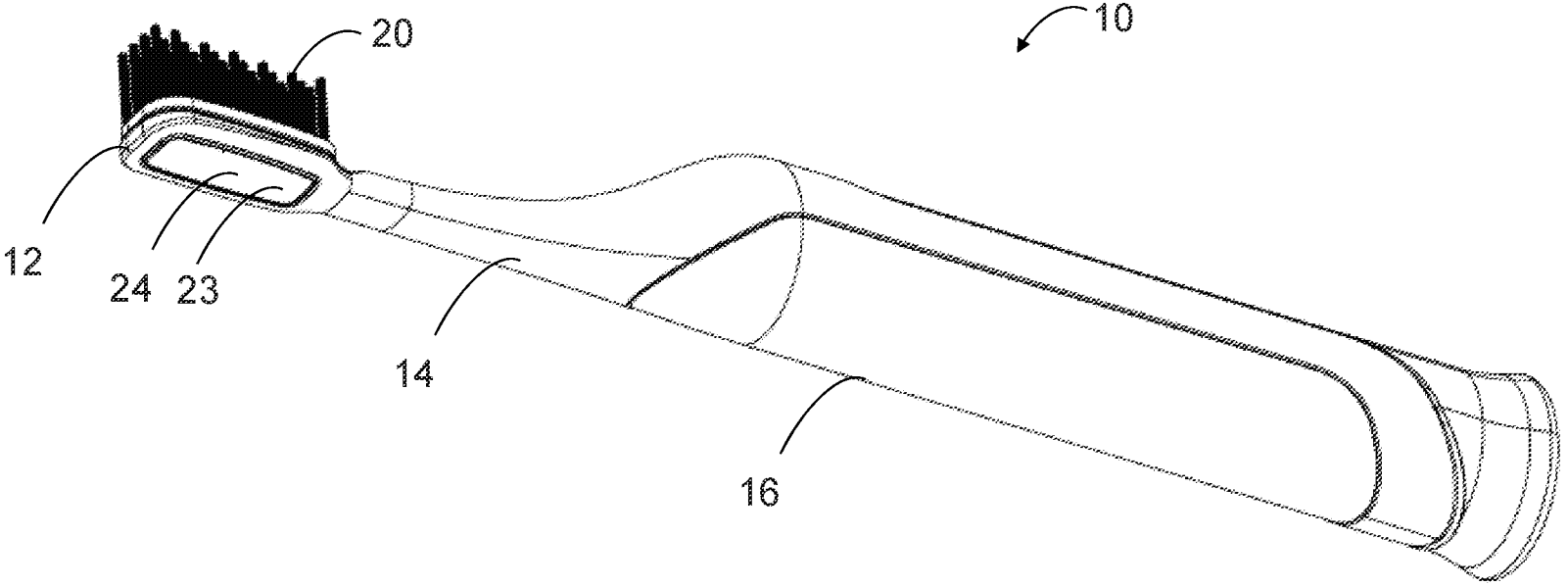
FIG. 2 is a bottom perspective view of the toothbrush.
Figure 3:
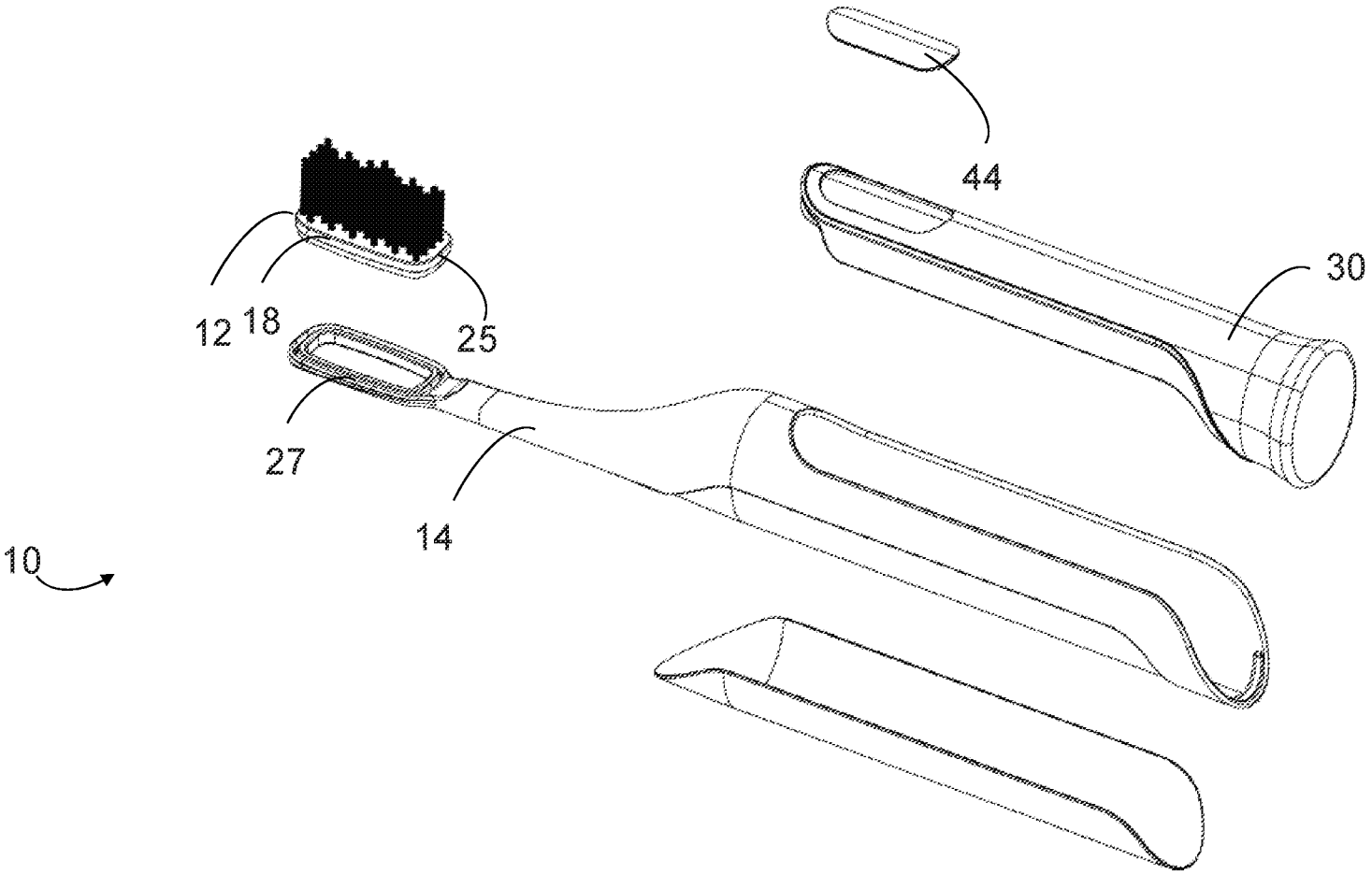
FIG. 3 is an exploded view of the toothbrush.

FIGS. 1 and 2 are top and bottom perspective views, respectively, of a toothbrush device 10 in accordance with one or more embodiments. The toothbrush device 10 includes a toothbrush head 12, a toothbrush head holder 14 for detachably holding the toothbrush head 12 in a use position (depicted in FIGS. 1-2) to be used for brushing the user's teeth, and a handle 16 having one end connected to the toothbrush head holder 14.

The toothbrush head 12 has a base 18 and toothbrush bristles 20 for brushing teeth extending from a front face 22 of the base 18. The opposite back face 24 of the base 18 has a snap-fit feature 25 mated with a corresponding snap-fit feature 27 in the toothbrush head holder 14. The snap-fit features 25, 27 form an annular snap-fit joint to securely hold the toothbrush head 12 in the use position.

The opposite back face 24 of the base 18 also has a textured surface 23 forming a tongue cleaner.

Figure 5:
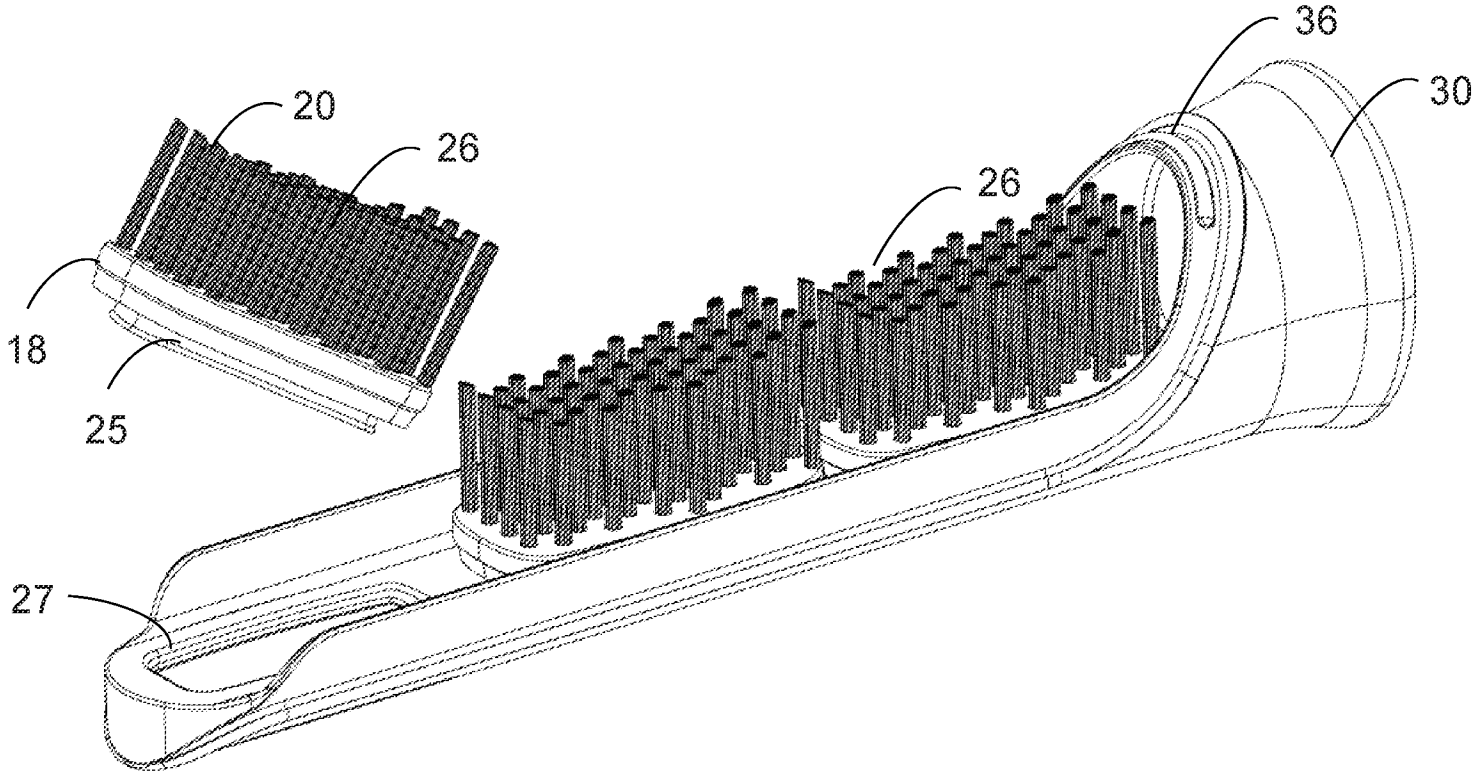
FIG. 5 is a perspective view of a portion of the handle of the toothbrush holding replacement toothbrush heads.

The handle 16 has a compartment therein for storing one or more replacement toothbrush heads 26 (shown in FIG. 5). The replacement toothbrush heads 26 have the same construction as the toothbrush head 12, and are configured to be used interchangeably in the toothbrush head holder 14.

Figure 4:
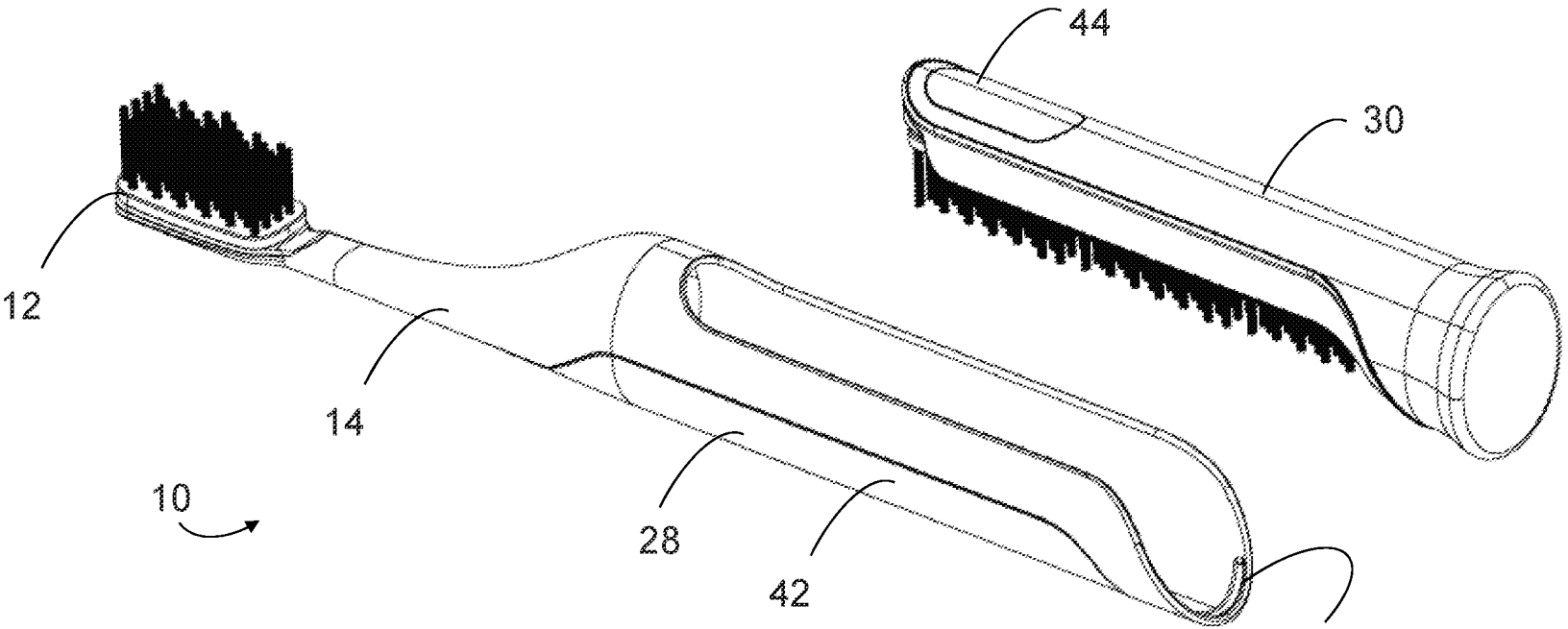
FIG. 4 is a perspective view of the toothbrush showing a portion of the handle being removed to access replacement toothbrush heads.

The handle 16 comprises a first section 28 and a second section 30 (shown in FIG. 4) detachably connected together to form the compartment. The first and second sections 28, 30 include mating snap-fit features 36, 38 allowing the sections to be securely connected together, but separable by the user when needed.

As shown in FIG. 5, the second section 30 includes recesses with snap-fit features 27 for mating with snap-fit features 25 of the replacement toothbrush heads 26. The snap-fit features 25, 27 form annular snap-fit joints to securely hold the toothbrush heads 26 in a stored position in the compartment.

The user can detach the second section 30 of the handle 16 from the first section 28 to enable access the one or more replacement toothbrush heads 26 stored in the compartment of the handle 16 such that the user can replace the toothbrush head 12 currently in the toothbrush head holder 14 with one of the replacement toothbrush heads 26 by snap-fitting a replacement toothbrush head 26 in the toothbrush head holder 14, when desired.

A portion 42 of the handle 16 can be made transparent such that the replacement toothbrush heads 26 in the compartment are visible to the user.

A thumb rest 44 can be provided on the second section 30 of the handle 16. The thumb rest can be a different color or material than the second section 30 for aesthetic purposes.

The handle and toothbrush head holder can comprise molded plastic material.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments.

Additionally, elements and components described herein may be further divided into additional components or joined together to form fewer components for performing the same functions. Accordingly, the foregoing description and attached drawings are by way of example only, and are not intended to be limiting.

The invention claimed is:

1. A toothbrush device useable by a user, comprising:

a toothbrush head having a base and toothbrush bristles for brushing teeth extending from a front face of the base and a snap-fit feature on an opposite back face of the base;

a toothbrush head holder having a snap-fit feature mated with the snap-fit feature of the toothbrush head for detachably holding the toothbrush head in a use position to be used for brushing the user's teeth;

a handle having one end connected to the toothbrush head holder, the handle having a compartment therein for storing one or more replacement toothbrush heads, each of the one or more replacement toothbrush heads having a base and toothbrush bristles for brushing teeth extending from a front face of the base and a snap-fit feature on an opposite back face of the base, wherein the handle comprises a first section comprising an open longitudinal slot having a length and a second section comprising a longitudinal length corresponding to the length of the open longitudinal slot detachably connected by additional snap-fit features to form the compartment, the second section including an elongated portion having one or more snap-fit features integrally formed therein on an interior side of the elongated portion facing said compartment, said one or more snap-fit features being mated with the snap-fit features of the one or more replacement toothbrush heads for detachably holding the one or more replacement toothbrush heads in the compartment, wherein the user can detach the longitudinal length of the second section from the open longitudinal slot of the first section via the snap-fit features to enable the user to access the one or more replacement toothbrush heads stored in the compartment of the handle such that the user can replace the toothbrush head in the toothbrush head holder with one of the one or more replacement toothbrush heads by snap-fitting the replacement toothbrush head in the toothbrush head holder, when desired.

2. The toothbrush device of claim 1, wherein the toothbrush head and the one or more replacement toothbrush heads each include a textured surface forming a tongue cleaner on the back faces thereof.

3. The toothbrush device of claim 1, wherein the snap-fit features on the toothbrush head and the one or more replacement toothbrush heads are identical.

4. The toothbrush device of claim 1, wherein the snap-fit features on the toothbrush head and the toothbrush head holder comprise an annular snap-fit joint.

5. The toothbrush device of claim 1, wherein the snap-fit features on the one or more replacement toothbrush heads and the second section of the handle comprise one or more annular snap-fit joints.

6. The toothbrush device of claim 1, wherein at least a portion of the first section of the handle is transparent such that the one or more replacement toothbrush heads in the compartment are visible to the user.

7. The toothbrush device of claim 1, further comprising a thumb rest on the second section of the handle, the thumb rest comprising a different color or material than the second section.

8. The toothbrush device of claim 1, wherein the handle and toothbrush head holder comprise molded plastic material.

9. A method of replacing a toothbrush head in a toothbrush device, comprising:

(a) removing the toothbrush head from a toothbrush head holder of the toothbrush device, the toothbrush head holder detachably holding the toothbrush head;

(b) accessing a replacement toothbrush head stored in a compartment in a handle of the toothbrush device connected to the toothbrush head holder by separating two snap-fitted sections comprising one snap-fitted section with an open longitudinal slot having a length and one snap-fitted section with a longitudinal length corresponding to the length of the open longitudinal slot forming the handle, wherein the replacement toothbrush head is detachably secured to one of the two sections through a snap-fit feature integrally formed in an interior side of the one of the two sections facing the compartment;

(c) removing the replacement toothbrush head from the one of the two sections;

(d) reconnecting the two sections together by snap-fitting the sections to form the handle; and (e) securing the replacement toothbrush head in the toothbrush head holder to enable the toothbrush device to be used to brush a user's teeth.

10. The method of claim 9, wherein step (e) comprises snap-fitting the replacement toothbrush head in the toothbrush head holder.

11. The method of claim 9, wherein the toothbrush head is snap-fitted to the toothbrush head holder.

12. The method of claim 9, wherein the toothbrush head and the toothbrush head holder include snap-fit features forming an annular snap-fit joint.

13. The method device of claim 9, wherein the replacement toothbrush head and the one of the two sections include snap-fit features forming an annular snap-fit joint.

14. The method of claim 9, wherein the first section and the second section are detachably connected by snap-fit features.

15. The method of claim 9, wherein at least a portion of the handle is transparent such that the replacement toothbrush head in the compartment is visible to the user.

16. A toothbrush device useable by a user, comprising:

a toothbrush head having a base and toothbrush bristles for brushing teeth extending from a front face of the base;

a toothbrush head holder, wherein the toothbrush head and the toothbrush head holder include means for detachably holding the toothbrush head in the toothbrush head holder in a use position to be used for brushing the user's teeth;

a handle having one end connected to the toothbrush head holder, the handle having a compartment therein for storing one or more replacement toothbrush heads, each of the one or more replacement toothbrush heads having a base and toothbrush bristles for brushing teeth extending from a front face of the base, wherein the handle comprises a first section comprising an open longitudinal slot having a slot and a second section comprising a longitudinal length corresponding to the length of the open longitudinal slot detachably connected by additional snap-fit features to form the compartment, the second section and the replacement toothbrush heads including means for detachably holding the one or more replacement toothbrush heads in the second section, wherein the user can detach the longitudinal length of the second section from the open longitudinal slot of the first section via the snap-fit features to enable the user to access the one or more replacement toothbrush heads stored in the compartment of the handle such that the user can replace the toothbrush head in the toothbrush head holder with one of the one or more replacement toothbrush heads, when desired.

17. The toothbrush device of claim 16, wherein the toothbrush head and the one or more replacement toothbrush heads each include a textured surface forming a tongue cleaner on back faces thereof.

18. The toothbrush device of claim 16, wherein at least a portion of the handle is transparent such that the one or more replacement toothbrush heads in the compartment are visible to the user.

19. The toothbrush device of claim 16, further comprising a thumb rest on the second section of the handle, the thumb rest comprising a different color or material than the second section.

* * * * *